US007191973B2

(12) United States Patent
Gretsch et al.

(10) Patent No.: US 7,191,973 B2
(45) Date of Patent: Mar. 20, 2007

(54) METHOD AND DEVICE FOR CONTROLLING THE TENSION OF A WEB

(75) Inventors: Harald Karl Gretsch, Eibelstadt (DE); Reinhard Georg Gross, Dettelbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 61 days.

(21) Appl. No.: 10/501,922

(22) PCT Filed: Jan. 22, 2003

(86) PCT No.: PCT/DE03/00163

§ 371 (c)(1),
(2), (4) Date: Jul. 28, 2004

(87) PCT Pub. No.: WO03/066492

PCT Pub. Date: Aug. 14, 2003

(65) Prior Publication Data

US 2005/0103818 A1 May 19, 2005

(30) Foreign Application Priority Data

Feb. 5, 2002 (DE) ..... 102 04 484
May 25, 2002 (DE) ..... 102 23 380

(51) Int. Cl.
*B65H 23/00* (2006.01)

(52) U.S. Cl. ..... 242/416

(58) Field of Classification Search ..... 242/416, 242/418.1, 563, 534; 226/91, 4, 24
See application file for complete search history.

(56) References Cited

U.S. PATENT DOCUMENTS

| | | | | |
|---|---|---|---|---|
| 3,510,036 | A * | 5/1970 | Lewis, Jr. et al. | 226/2 |
| 6,106,177 | A | 8/2000 | Siegl et al. | |
| 6,211,968 | B1 | 4/2001 | Glockner et al. | |
| 6,363,297 | B1 | 3/2002 | Wienholt et al. | |
| 2002/0108983 | A1 | 8/2002 | Cote et al. | |
| 2003/0079629 | A1 | 5/2003 | Albert et al. | |

FOREIGN PATENT DOCUMENTS

| | | |
|---|---|---|
| DE | 1 966 795 | 4/1969 |
| DE | 196 14 300 A1 | 10/1996 |
| DE | 197 54 878 A1 | 6/1999 |
| DE | 198 34 724 A1 | 7/1999 |
| DE | 198 34 725 A1 | 2/2000 |
| DE | 101 10 122 A1 | 9/2001 |
| DE | 102 01 993 A1 | 8/2002 |
| EP | 0 837 825 B1 | 1/2001 |

* cited by examiner

*Primary Examiner*—Patrick Mackey
*Assistant Examiner*—William E. Dondero
(74) *Attorney, Agent, or Firm*—JonesTullarCooper, P.C.

(57) ABSTRACT

Tension in a web of material that is passing through a web treatment machine, such as a web-fed rotary printing press, is controlled. The desired value for the web tension is modified to counteract defects that may influence web tension during production operation of the web treatment machine. The modification of the web tension is done in advance of, or concurrently with the arrival of the defect that influences the web tension.

66 Claims, 3 Drawing Sheets

METHOD AND DEVICE FOR CONTROLLING THE TENSION OF A WEB

CROSS-REFERENCE TO RELATED APPLICATIONS

This application is the U.S. National Phase under 35 U.S.C. 371 of PCT/DE03/00163, filed Jan. 22, 2003; published as WO 03/066492 A1 on Aug. 14, 2003 and claiming priority to DE 102 04 484.8 filed Feb. 5, 2002 and to DE 102 23 380.2 filed May 25, 2002, the disclosures of which are expressly incorporated herein by reference.

FIELD OF THE INVENTION

The present invention is directed to a method and to a device for regulating a web tension. Interferences occurred during web processing and affecting the web tension are compensated for by a regulating device.

BACKGROUND OF THE INVENTION

A method for regulating web tension is disclosed in EP 0 837 825 B1. In addition to the measured actual values of the web tension, further values defining the machine status, and defining method-related properties are employed for the regulation. Besides the actually measured tension values, predeterminable web-specific parameters are also included in the regulating algorithm.

DE 198 34 725 A1 shows, inter alia, a method for regulating a web tension. Actual web tension values upstream and/or downstream of the printing unit are entered into a regulating device, which regulates the web tension at the draw-in device in such a way that, in spite of interference values such as, for example, a varying module of elasticity of the web, the web tension is maintained within a range which is optimal for the inking and cutting registrations.

The object of DE 197 54 878 A1 is to provide a winding tightness on a roll as constant, or as pre-definable, as possible.

For obtaining a uniform wind-up roll curve, values measured by the unwinding roll curve are used for affecting the forces in accordance with the desired paper winding characteristic reference variable, such as winding tightness. Then, the measured values are used together with the empirical values.

A method and a device of a pre-printed web is known from DE 19 66,795 A1. In connection with a roll change a web tension is reduced at least temporarily, for example for assuring a correct alignment of the lines in the renewed printing of the web.

SUMMARY OF THE INVENTION

The object of the present invention is directed to providing a method and a device for regulating a web tension.

In accordance with the present invention, this object is attained by regulating the tension in a web passing through a processing machine. Interferences occurring during processing, and affecting the web tension, are compensated for by a regulating device. The web tension is maintained at a reference value or within a permissible range. This reference value may be reduced temporarily with respect to an actually existing reference value. This change in reference value counteracts an interference which affects the web tension.

The advantages which can be attained with the present invention consist, in particular, in that by the use of a pre-control or a pre-regulation, it is possible to reduce the expected effects on the printing process in the course of a foreseeable interference, such as, in particular a roll change, and therefore to minimize the amount of resultant waste. The regulation takes place chronologically shortly prior to, or at the start of the interference with an affected unit, not after the occurrence of a negative effect. By this method it is possible to reduce a long settling time, as well as to reduce the danger of a web tear. The reduction, or the removal of the effect of a foreseeable interference therefore anticipates the interference itself, or takes place simultaneously with the buildup of the interference, without having to rely on retroactively determined measured values. In a further development, it is possible, in accordance with the present invention, to additionally refer to measured values of the web tension. This can be advantageous for optimization and/or for a self-optimizing or learning system.

In connection with interferences occurring in the course of changing webs of material to be imprinted, or of their rolls, in particular, it is possible to counteract those interferences with the aid of the tension regulation of the present invention, and the resultant waste can be minimized. This regulation of web tension is achieved, in an advantageous embodiment, in that a pre-regulation or a pre-control of drive mechanisms or of adjusting elements, in view of the expected changes in the web tension, takes place during the gluing, the cut-off of the "old" web, or the entry into the printing press of the start of a fresh web which is to be imprinted.

By the use of the pre-regulation or of the pre-control of the subject invention, the response times of a regulating device, which is operated "retrospectively" during the production in a cause-effect-countermeasures mode, and/or the response time or the asymptotic approach to the reference variable, are clearly reduced. An elaborate color registration, for compensating for a negative result of the roll change, can be omitted. In connection with one preferred embodiment, the tension at the draw-in unit is preferably reduced by a predeterminable value, and in another preferred embodiment the tension is reduced to a predeterminable value.

If a web tension regulating device, for the running operation of the printing press, already exists, it is advantageous to add an offset to the reference variable of the web tension regulation at the draw-in unit. This offset can be overlaid on the reference variable at the draw-in unit as either a one-time value, in the form of discrete steps, or as a continuous function within a time interval. In a further development of the present invention, the time interval can be preset, for example as a function of the running time of the glue spot from the roll changer to the hopper inlet, i.e. as a function of the production speed or the number of revolutions, and possibly as a function of the path. In another preferred embodiment, the offset, or the reduction is entered without a ramp, in the form of a stepped function, at the relevant time.

If there is no regulating device operating automatically during production, the actuator drives, or the individual drive mechanisms can undergo a correction, for example by the use of an appropriate actuating command, at the occurrence of the interference, or in the run-up stage of the occurrence of the interference, for example at the entry of the fresh web start into the printing press, in order to minimize or to compensate for the expected error.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

A processing machine, for example a web-fed rotary printing press, has several processing steps, or processing units, located along the path of travel of a web 01, for example a web 01 to be imprinted, in particular a paper web 01, which web 01 is moving in the web transport direction T.

Figure 1:
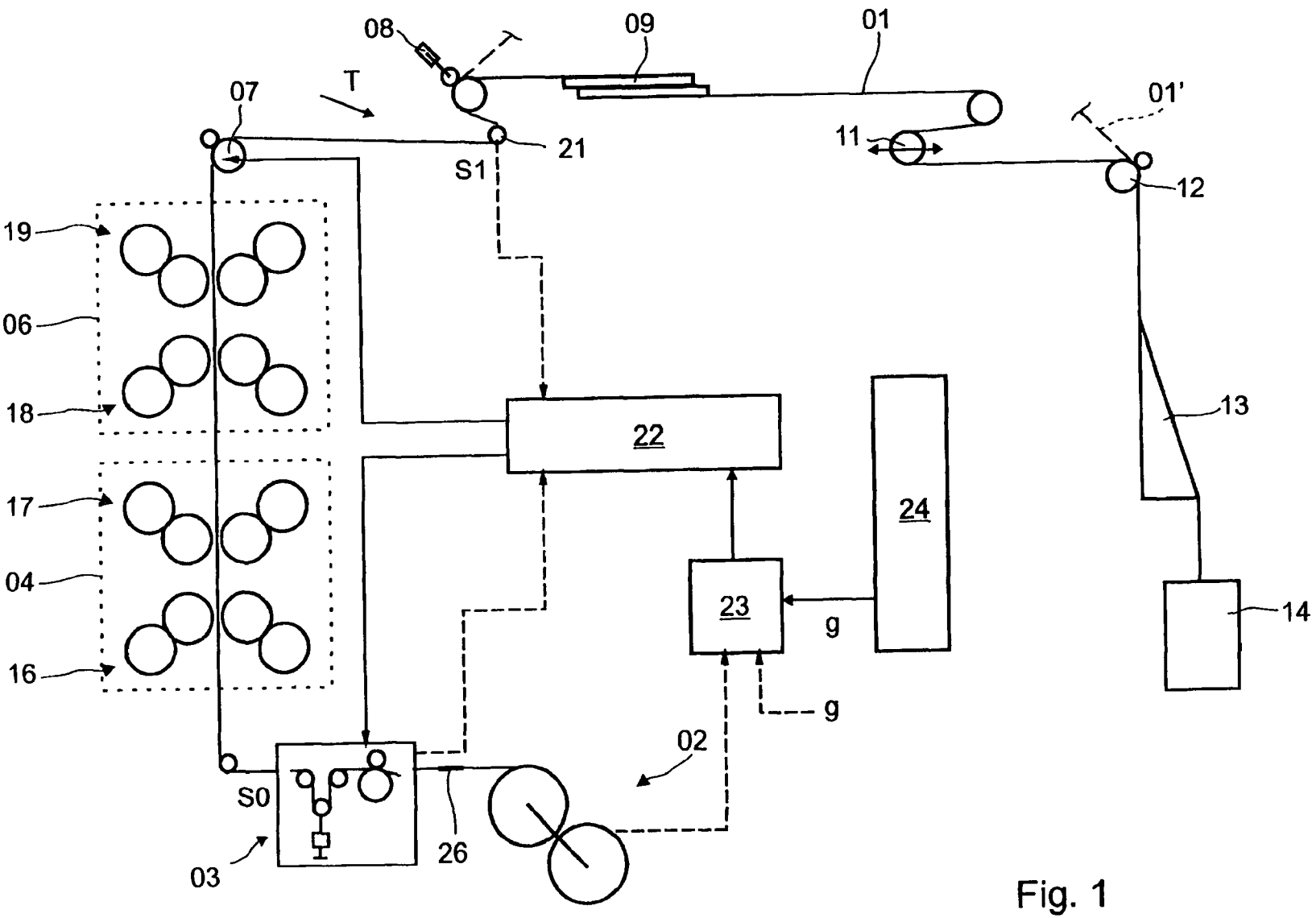
FIG. 1, a schematic representation of a rotary printing press with web tension regulation in accordance with the present invention, in FIG. 2, a schematic representation of the chronological progression of a tension occurring without application of the method of the present invention, in FIG. 3, a schematic representation of a first preferred embodiment of the chronological progression of the change of a reference variable for the regulation of the tension, in FIG. 4, a schematic representation of a second preferred embodiment of the chronological progression of the change of a reference variable for the regulation of the tension, and in FIG. 5, a schematic representation of a third preferred embodiment of the chronological progression of the change of a reference variable for the regulation of the tension of a web, all in accordance with the present invention.

For a web-fed rotary printing press, as schematically represented in FIG. 1, these processing steps or units can be, for example, a roll changer 02, a web draw-in unit 03, one or several printing units 04, 06, a traction roller 07, a longitudinal cutting device 08, if desired, turning devices 09 and registration devices 11 such as, for example, a linear registration roller 11, a further traction roller 12, for example in the form of a so-called hopper inlet roller 12, as well as formers 13 and a folding unit 14 with transverse cutting devices, which are not specifically represented. In addition to this, further, non-represented processing steps or units, such as a varnishing unit, dryer, etc can be arranged in the processing machine.

Each printing unit 04, 06 has one or more printing groups 16, 17, 18, 19, for example double printing groups 16, 17, 18, 19 which are usable for imprinting on both sides of web 01, wherein the printing groups 16, 17, 18, 19 can be arranged side by side or also on top of each other. If several printing units 04, 06 are provided, these several printing units 04, 06 can also be arranged next to, or on top of each other, with a resultant horizontal or vertical path of the web 01.

The web 01 is unwound from the roll changer 02 and passes through the printing groups 16, 17, 18, 19, which print the web 01 sequentially, for example which print four times on the same side of the web 01.

In order to maintain the congruence of the pages during multiple printing, or to maintain the registration of the web during printing on both sides, and to maintain the cutting registration when combining several webs 01, 01', or partial webs 01, 01', and during transverse cutting, the maintenance of the congruence or of the registration can be checked at one or at several locations along the path of the web 01. For fully automatic printing presses, this checking takes place, for example, by the measuring of the position of marks which are applied by the printing groups 16, 17, 18, 19, or of print images, by the use of a sensor, which is not specifically represented. In this case, the signals from the sensor are supplied to a control unit, also not specifically represented, for correcting the registered deviations in congruence or registration. Actuating devices such as, for example, linear registration rollers, angle of rotation positions, etc., are actuated to correct these register deviations.

As a rule, changes in web tension are detected at one location or at several locations along the path of travel of the web 01 by the use of measuring rollers, such as the measuring roller 21 shown, by way of example, downstream of the last printing group 19, or in any other suitable way. These changes in web tension are processed in a regulating unit 22 and are, in case of a deviation from a reference variable or a permissible range, the web tension is returned to these reference variables. For example, the tension S1 downstream of the last printing group 19 is detected at the measuring roller 21, is processed in the regulating unit 22, and a signal for maintaining the desired tension S1 is sent to the drive mechanism of the traction roller 07 and/or to the draw-in unit 03. A tension S0 upstream of the first printing group 16, in particular, determines the level of all of the web tensions along the path of the web 01 up to the entry into the hopper, and this tension is regulated via the draw-in unit 03, for example.

In case of a measured, already occurring deviation of an actual value of the tension from the reference variable, a regulation principle operating "retrospectively" returns the actual value of the tension to the desired reference variable by triggering drive mechanisms or actuating mechanisms. Such a regulating principle is employed, for example, during "normal" continued printing without large fluctuations in the conditions. This regulating principle therefore reacts to already occurred and registered changes in web tension.

The causes of interferences, and the changes resulting in the web tension therefrom, can be many. For example, changes in the printing press state, such as accelerations, changes of values in the printing process, such as changes in dampening agent and in ink supply, changes in contact pressures, changes in the properties of the web 01, such as the tension-stretching behavior, the thickness, the moisture absorption of the web, etc can all affect web tension.

A roll change, and the course of a resultant connection 26 between an old web and a fresh web 01, in particular a connection in the form of a glue spot 26, through the printing press, represents a substantial, but also a foreseeable interference with web tension. In comparison with the thickness of the single web 01, the glue spot 26 has a greater thickness, possibly also with the addition of an adhesive tape or of an adhesive, and has elastic properties which are different from the web 01. In addition, the old web and the fresh web 01 can also have different properties, such as different moisture, winding tightness and/or tension-stretching characteristics.

In the course of their entry into the printing press, these interferences, in particular the last mentioned interference, cause a large change in the tension of the web 01 and in the registration errors connected therewith. Registration errors caused by a roll change between the printing groups 16, 17, 18, 19 cannot be compensated for at all, or only by the use of elaborate techniques, by the above-mentioned registration regulation.

The method for web tension regulation in accordance with the present invention now provides a counteraction to the imminent changes in the web tension S0, S1 in a method wherein a preset reference variable S0-soll, S1-soll is changed, and in particular is reduced. In a first example, the reference variable S0-soll, S1-soll is reduced by a definite amount ΔS-soll, and in a second example is reduced, at least temporarily, to a predeterminable reference variable S0-fix, S1-fix. In a preferred embodiment, both reductions are accomplished by the reduction of the reference variable S0-soll of the web tension S0 upstream of the first printing group 16 by use of the draw-in unit 03.

Figure 2:
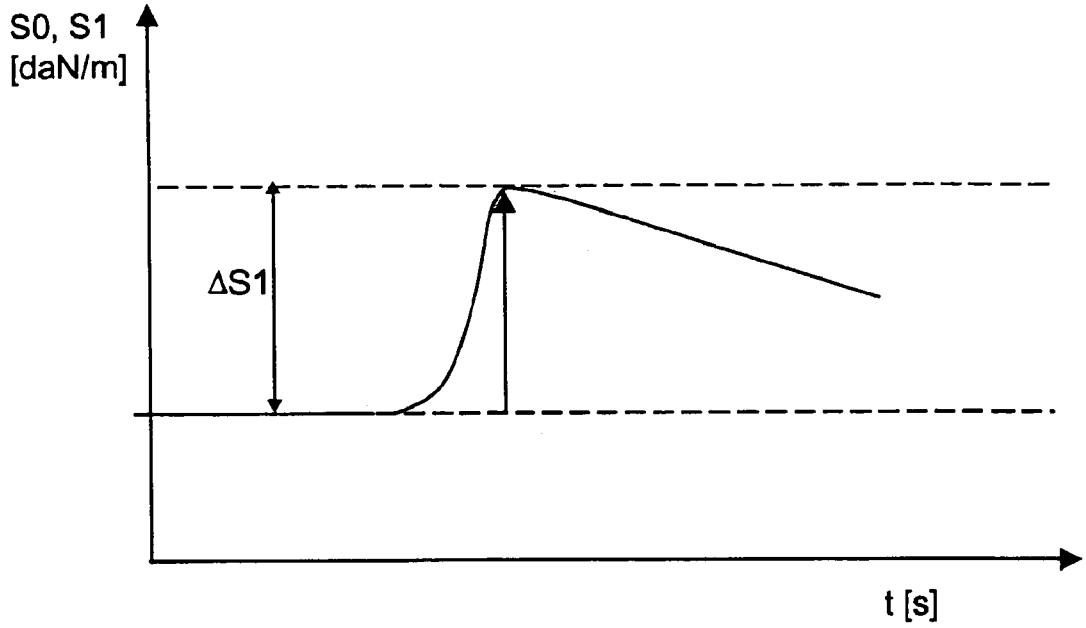

FIG. 2 schematically shows a chronological progression of, for example, the tension S1 without the present method being utilized. As soon as the glue spot 26 passes through the draw-in unit 03, a steep rise of the tension S1 starts, and progresses as far as the entry of the glue spot 26 into the hopper inlet. The same progression applies for the course of the tension S0, but is chronologically offset slightly toward the "front", i.e. to the left in FIG. 2. Thereafter, the tension S1 is on a level which is increased by an amount ΔS1 and decreases only slowly. The increased levels of the tensions S0, S1, etc., deviating, in particular, with a large amplitude from the reference variable S0- soll, S1-soll, causes registration errors between the printing groups 16 to 19 because of the change in the stretching behavior of the web 01.

Figure 3:
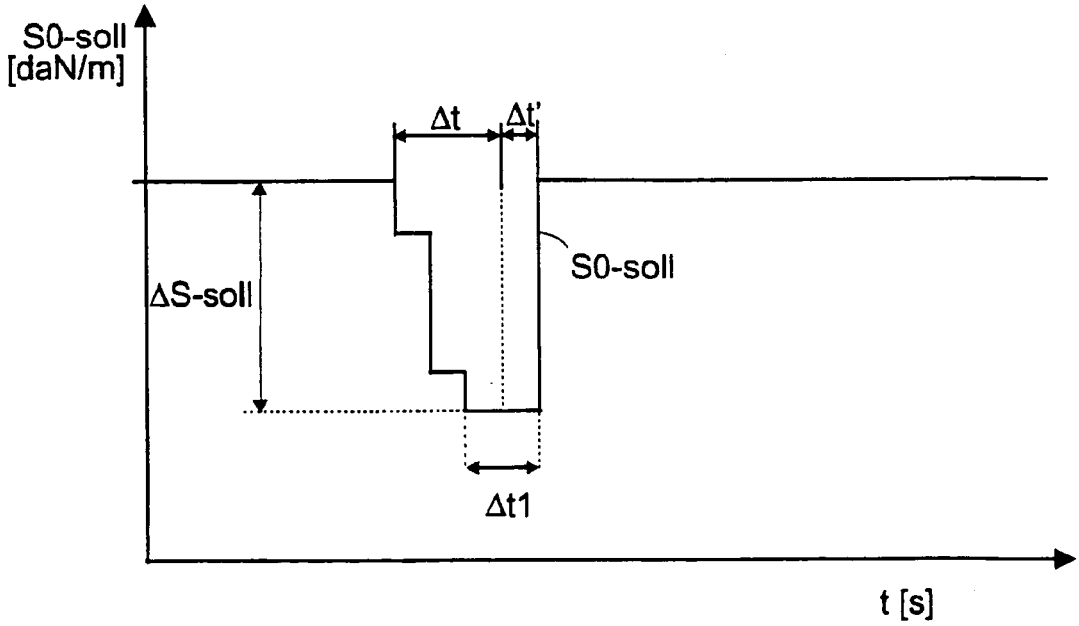

Now, in a first preferred embodiment of the present invention, as depicted in FIG. 3, these registration errors are avoided, or are reduced, in that the reference variable S0-soll of the web tension S0 is reduced by the amount ΔS-soll. This predetermined amount ΔS-soll can advantageously be changed and corresponds, for example, to a mean empirical value of the expected increase, without an appropriate reduction, of the tension S0 by the amount ΔS0. In particular, the amount ΔS0 can be selected in such a way that after the reduction of the tension S0 resulting from the change of the reference variable S0-soll, the tension S0 initially swings below the original reference variable S0-soll, S1-soll and, following a pass through of the interference, the reference variable S0-soll, S1-soll, swings above the reference variable S0-soll, S1-soll, wherein the respective absolute deviation at the minimum or maximum from the original reference variable S0-soll, S1-soll is considerable in contrast to the resulting deviation without the reduction. The tension S0, S1 fluctuates with a clearly reduced amplitude around the original reference variable S0-soll, S1-soll. This amount ΔS-soll can be stored, for example, in a memory unit 23 or determined in a computing unit 23 which is depicted in FIG. 1. in the case where the changes in the tensions S0 and S1 are of the same size, this size can correspond to the amount ΔS1, represented only as an example of the tension 51 in FIG. 2 or, as described above, to a portion of this amount ΔS1. However, it can also be determined by a chronological progression of the tension S0 corresponding to FIG. 2, or in other ways, for example by tests.

Figure 4:
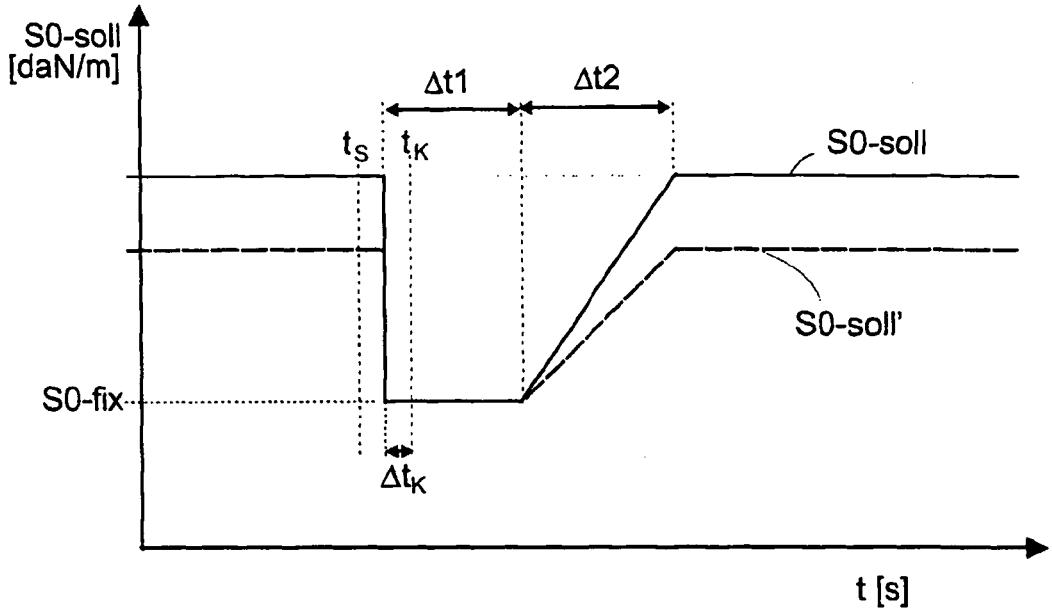

The chronological progression of the reference variable S0-soll is schematically applied in FIG. 3, parallel with the tension S0 or S1 shown in FIG. 2. In the course of the passage of the glue spot 26 through the draw-in unit 03, or slightly prior to that passage and in particular shortly before the actuation of a severing blade, or at that time at the latest, the reference variable S0-soll is reduced. This can take place in a single step, or can take place continuously, for example in the form of a ramp, or can take place in several stages, as represented in FIG. 3. in the present embodiment, as depicted in FIG. 3, the reference variable S0-soll is not reduced in bne step, but is reduced in a plurality of steps during a time interval Δt, which time interval can be determined from empirical values, or in particular from the running time of the web 01 from the draw-in unit 03 to the hopper inlet roller 12. In one embodiment, the reference variable S0-soll, reduced in the end by the amount ΔS-soll, can be maintained over a time interval Δt', as seen in FIG. 3, past the time of the maximum of the tension S1, as seen in FIG. 2, which would be expected without the reduction, before the reference variable S0-soll is returned, either in one step, or continuously, or in a plurality of smaller steps, back to the reference variable S0-soll desired for the printing press status. The "normal" tension regulation, if provided, then again takes over the regulation of the tensions S0, S1 and is responsible for this regulation. in a second preferred embodiment of the present invention, as depicted in FIG. 4, the reference variable S0-soll is not reduced by a fixed amount ΔS-soll, but is temporarily reduced to a fixed new value S0-fix, which can be predetermined and/or changed. For example, by use of this method, it can be assured that the tension S0 upstream of the printing unit 04 does not drop so far that the tension 51 downstream of the printing unit 04 falls into a range which is critical for the web run, for example below 8 daN/m.

The chronological progression of the reference variable S0-soll is represented in FIG. 4, which reference variable initially remains at a constant level. Now, in the course of the occurrence of a foreseeable interference, in particular of a roll change, this reference variable S0-soll is purposely reduced to a fixed value S0-fix. As previously mentioned, the reduction of the reference variable can, in principle, take place at any arbitrary, but fixed, time in relation to the time of the roll change and is triggered by various signals provided to the control/regulation of the printing press, or also by measured signals.

However, it is advantageous if the reduction of the reference variable takes place no later than the occurrence of the interference, but preferably takes place shortly prior to the interference. In the case of the flying roll change considered, the web tension effecting interference occurs with the gluing of the fresh web 01 to the old web 01 and with the almost simultaneous cutoff of the old web 01. In an advantageous embodiment, this time $t_K$ of web gluing and/or cutting constitutes the reference point for reducing the reference variable S0-soll of the tension S0 upstream of the printing unit 04 by operation of the web draw-in unit 03.

Although the reduction in web tension, in accordance with the example depicted in FIG. 4, is tied to the gluing process, such as the activation of the gluing roller and/or activation of the severing blade, it does not have to take place at the time $t_K$ of the triggering of the gluing roller and/or the severing blade, but can take place earlier while expecting such gluing and/or cutting. As represented in FIG. 4 by use of the time interval $\Delta t_K$, reducing the reference variable S0-soll takes place at a fixed, but at a settable chronological distance prior to the time $t_K$ of the gluing and/or cutting. For example, the time interval lies between 50 and 400 ms, and in particular lies between 50 and 250 ms. Matching and optimizing of the above mentioned "back swing" to the printing press and the path of the paper can take place by the selection of the time interval $\Delta t_K$.

Since the time for reducing the reference variable S0-soll lies prior to the actual time $t_K$ for the gluing/cutting, it is advantageous to tie the time for the reduction of the reference variable to information regarding the printing press state or to measured values, by which the time $t_K$ for gluing/cutting is also determined. For example, this can be a known diameter of the old roll to be changed. The time for the reduction of the reference variable can also be correlated in relation with a process which has a defined chronological connection with the gluing/cutting. Such a process is, for example, the bringing of a gluing frame into position, i.e. a time $t_s$ of the signal for pivoting. Such a time lies, for example, between 100 to 500 ms prior to the time $t_K$ for gluing/cutting, so that the time for the reduction lies approximately 50 to 450 ms after the time ts for pivoting. The reduction can be tied, for example, to a defined roll diameter, for example 130 mm, and to the gluing/cutting tied to a roll diameter of 125 mm. The distance between the two values used can also be correlated with the instantaneous production speed, or with a number of revolutions, for example linearly.

The predetermination of the reference variable, i.e. the reference variable S0-soll, is now reduced to S0-fix, for example without a chronological ramp in one step, and remains there for a constant, but a predeterminable time interval Δt1. Subsequently, the reference variable S0-soll is raised along a ramp, or possibly also along a step function, within a time interval Δt2 back to the original reference variable S0-soll. The time intervals Δt1 and Δt2 have, for example, been selected to be on the same order of magnitude, for example $0.5*\Delta t1 \leqq \Delta t2 \leqq 2.0*\Delta t1$. However, in principle it is also possible to perform the reduction in steps or along a steep ramp, for example.

If a different basic level of the tensions S0, S1 of the web 01 is desired for a different production—for example for a different web course, or a different sequence of the web 01 at the hopper inlet, the reference variable S0-soll' initially lies, as represented in the example of FIG. 4 by the depiction of a lower reference variable S0-soll', at this reference variable S0-soll' before it is also reduced to the fixed value S0-fix in order to be returned afterwards, after the time interval Δt1, to its original reference variable S0-soll' within the time Δt2.

An example of a possible control circuit for regulating the tension S0 is schematically integrated in FIG. 1. in a conventional control circuit, the regulating unit 22 makes sure that the tensions S0, S1 are each maintained at the desired reference variable S0-soll, S1-soll. For this purpose, actual values of tensions S0, S1 are provided as input values, are compared with the reference variables S0-soll, S1-soll, and appropriate drive mechanisms are set by the use of appropriate output values. For example, the reference variables S0-soll, S1-soll can be provided by a printing press control device 24, or can be formed in the regulating unit 22 itself from values g, which values g define the printing press status, in the regulating unit 22.

During a roll change, for example at the time of connecting of the webs, at the time of severing the "old" web 01, during the passage of the glue spot 26 through the draw-in unit 03, or at a time interval $\Delta t_K$ relative to one of these times, an amount ΔS-soll made available by the memory or by the computing unit 23 in the first preferred embodiment, is added as a negative "offset", for example as a step function, to the reference variable S0-soll and is maintained during the time interval Δt', for example, after the end value has been reached. In the second preferred embodiment, the reference variable S0-soll is decreased to the value S0-fix in order to maintain it there over the time interval Δt, and subsequently to return it to its original value along a ramp. Once the interruption has ended, i.e. once the glue spot 26 is at the former 13, or the additional time interval Δt' or the time interval Δt2 has passed, regulation is again left to the "normal" tension control device with the predetermined reference variables S0-soll, S1-soll, etc.

In a further development of the present invention, the memory or computing unit 23 is additionally provided with, in addition to information regarding the material, for example the type of paper and the web width, substantial values g, which affect the properties or the behavior of the web 01, from the printing process, the printing press status and/or the web conveyance, such as, for example, the supply of dampening agent and/or ink, the actual web tensions, contact pressures, speed, temperatures, accelerations and/or the course of the web 01. In the first preferred embodiment, it is possible to select the suitable temporary correction of the reference variable S0-soll by the amount ΔS0 for the tension S0, or to calculate it, or to determine the optimized chronological progressions, times and time intervals Δt, ΔT1, Δt2, Δt', for the appropriate production in the two preferred embodiments.

It is also advantageous if data regarding the amounts ΔS0 and/or ΔS-soll, which were determined in the past, as well as determining in the present circumstances, are stored in the memory or the computing unit 23. Together with the regulating unit 22, in a further development such a memory or a computing unit 23 can then be embodied as a self-learning system and can optimize the regulating process performed for the roll change ahead of time or at least simultaneously. In the ideal case, no correction of the tensions S0, S1 need to be performed after the amount ΔS-soll has been completely returned, so that it can be used as a measure for the quality achieved by use of the correction.

Any other suitable method can also be applied for triggering the reduction of the reference variable S0-soll. It is thus possible, for example, to determine the time, by the detection of the steep flank, of one of the tensions S0, S1, or a visually detected passage of the glue spot 26 at a defined location, or the definition of a time relative to the roll change within the scope of a program of the printing press regulation. However, it is important that, for counteracting the interference, the reference variable for the tension is definitely changed, at least temporarily, and not only after the extent of the negative interference has been determined.

In contrast to the second preferred embodiment, in a third preferred embodiment, the reference variable S0-soll is returned to the original reference variable S0-soll, or a new fixed reference value S0-soll' from the fixed value S0-fix not along a predetermined ramp, but on the basis of a measurement of the tension S1, S0. In particular, the tension S1 downstream of the last printing unit 19 may be measured, for example, by the measuring roller 21. A new fixed reference variable S0-soll' can be necessary, for example, if the paper type, i.e. if the basic properties of the paper, are also to be changed during the roll change. This information can then be taken from the printing press control, for example, and can be taken into consideration for the uninterrupted operation when forming the reference variable S0-soll, S1-soll, S0-soll'.

Figure 5:
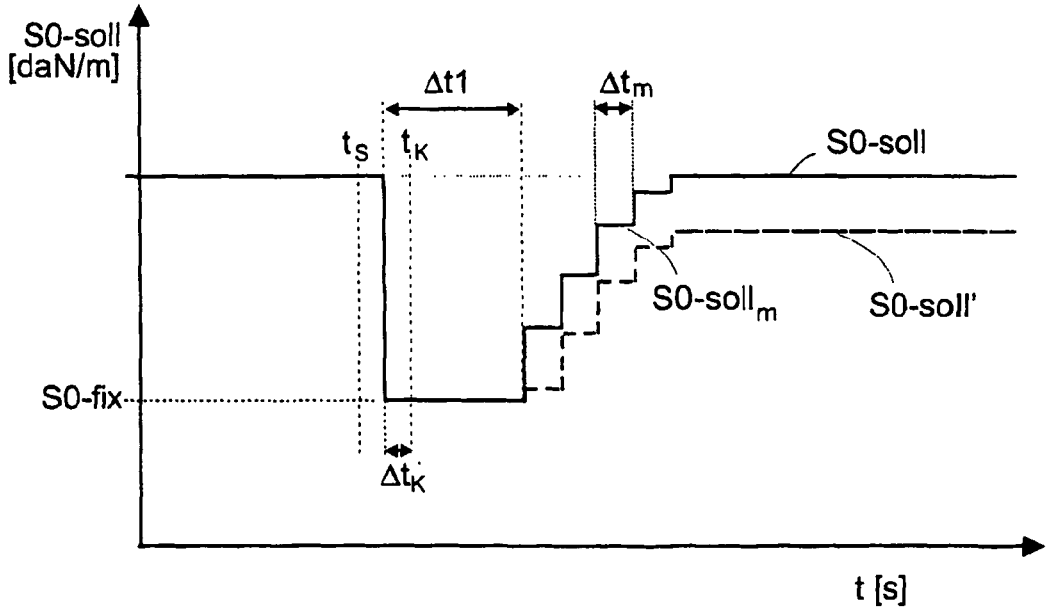

The return can be based, for example, on a continuous or on discontinuous measured value pick-up wherein, however, a reference variable S0-$soll_{m'}$ which is valid for the next time interval $\Delta t_m$, is determined in defined, possibly selectable, time intervals $\Delta t_m$ by use of the measured value, and is supplied to the regulating device. A stepped return of the reference variable S0-soll resulting from this is represented, by way of example, in FIG. 5. However, the return to the original reference variable S0-soll or to a new fixed reference variable S0-soll' can also be determined in another way by use of the measured values S1-ist and can be preset. Thus it is possible, for example, to determine a slope of partial ramps in sections from two or from several measured values, wherein then the ramp represented in FIG. 4 can have different slopes in sections as a function of the measured values.

The determination and the regulation of the reference variables S0-soll$_m$, or of the sectionally determined slopes can be provided from the measurements in an advantageous embodiment for example by the use of a fuzzy regulation, and in a simpler embodiment, by the use of a PID controller.

It is basically possible, in accordance with the present invention, to combine the procedures of the three above discussed examples. For example, a reduction of web tension, in accordance with example one, and a return of web tension, in accordance with example three, can take place. In all three examples, it is also possible to provide predetermined ramps, possibly changeable ones, for the reduction. The return from the third example can be applied to the second example. In the same way, the reduction by a defined amount ΔS-soll can also be transferred to examples two and three, while the reduction to a defined fixed value S0-fix can be transferred to example one.

While preferred embodiments of a method and device for controlling the tension of a web, in accordance with the present invention, have been set forth fully and completely hereinabove, it will be apparent to one of skill in the art that various changes in, for example the type of web being printed, the drives for the printing units and the like could be made without departing from the true spirit and scope of the present invention which is accordingly to be limited only by the appended claims.

What is claimed is:

1. A method for regulating a tension of a web of material passing through a processing machine including:

providing a regulating device for controlling said web tension;

providing a computing unit for controlling said regulating device, said computing unit generating a time based, predetermined web tension control function in response to a sensed web tension affecting interference; said control function being dependent on information regarding the material from which said web is formed;

sensing the occurrence of a web tension affecting interference during processing of said web in said processing machine;

in response to said sensing, applying said time based control function to said regulating device for selectively reducing a value of said tension from an existing value to below a serected reference value at least temporarily and after a period of time, returning said tension value to said existing value.

2. The method for regulating a tension of a web of material passing through a processing machine of claim 1, further including:

providing a plurality of printing groups in said processing machine and including a first printing group and a last printing group in a direction of web travel through said plurality of printing groups;

measuring tensions in said web before said first printing group and after said last printing group and;

using said regulating device for returning said tension value to said existing value upstream of said first printing group using said measured value of said tension in said web after said last printing group.

3. The method of claim 2 further including reducing said selected reference value to a fixed value.

4. The method of claim 2 further including reducing said selected reference value a predetermined amount in respect to said existing value.

5. The method of claim 4 further including connecting an old web and a new web and using said connecting for changing said reference value.

6. The method of claim 2 further including storing at least one value of an amount of change of said reference value in said computing unit.

7. The method of claim 6 further including reducing said reference value discontinuously in time intervals.

8. The method of claim 2 further including providing a memory unit and using said computing unit for storing at least one correlation for determining a change of said reference value.

9. The method of claim 2 further including maintaining said reference value as a desired tension value for a constant time interval.

10. The method of claim 2 further including reducing said reference value in one step.

11. The method of claim 2 further including changing said reference value during one of run-up of said interference or during said interference.

12. The method of claim 2 further including performing a roll change for causing said interference.

13. The method of claim 2 further including connecting an old web and a new web and using said connecting for changing said reference value.

14. The method of claim 2 further including providing a web draw-in unit and using said web draw-in unit for changing said reference value.

15. The method of claim 2 further including connecting a new web and an old web and changing said reference value during said connection.

16. The method of claim 2 further including providing a web connection and changing said reference value at least during a passage of said connection before, in said transport direction a last clamping point located before said first printing unit.

17. The method of claim 2 further including changing said reference value and maintaining said changed reference value for a time interval.

18. The method of claim 17 further including returning said reference value to said existing value after said time interval.

19. The method of claim 18 further including using a time function for returning said reference value.

20. The method of claim 19 further including returning said reference value discontinuously in time intervals.

21. The method of claim 17 further including returning said reference value to a new constant reference value different from said existing value after said time interval.

22. The method of claim 21 further including using a time function for returning said reference value.

23. The method of claim 22 further including returning said reference value discontinuously in time intervals.

24. The method of claim 1 further including reducing said selected reference value to a fixed value.

25. The method of claim 1 further including reducing said selected reference value a predetermined amount in respect to said existing value.

26. The method of claim 25 further including selecting said predetermined amount for counteracting an expected change in said web tension.

27. The method of claim 1 further including using said computing unit for storing at least one correlation for determining a change of said reference value.

28. The method of claim 1 further including maintaining said reference value as a desired tension value for a constant time interval.

29. The method of claim 1 further including reducing said reference value in one step.

30. The method of claim 1 further including changing said reference value during one of run-up of said interference or during said interference.

31. The method of claim 1 further including performing a roll change for causing said interference.

32. The method of claim 1 further including connecting an old web and a new web and using said connecting for changing said reference value.

33. The method of claim 1 further including providing a first printing unit in said processing machine and altering said reference value of said web tension before, in a transport direction of said web, said first printing unit.

34. The method of claim 33 further including providing a web draw-in unit and using said web draw-in unit for changing said reference value.

35. The method of claim 33 further including connecting a new web and an old web and changing said reference value during said connection.

36. The method of claim 33 further including providing a web connection and changing said reference value at least during a passage of said connection before, in said transport direction a last clamping point located before said first printing unit.

37. The method of claim 1 further including changing said reference value and maintaining said changed reference value for a time interval.

38. The method of claim 37 further including returning said reference value to said existing value after said time interval.

39. The method of claim 38 further including using a time function for returning said reference value.

40. The method of claim 39 further including returning said reference value discontinuously in time intervals.

41. The method of claim 37 further including returning said reference value to a new constant reference value different from said existing value after said time interval.

42. The method of claim 41 further including using a time function for returning said reference value.

43. The method of claim 42 further including returning said reference value discontinuously in time intervals.

44. A method for regulating a tension of a web of material passing through a printing machine including:

sensing the occurrence of a web tension affecting interference during processing of said web in said processing machine;

providing a computing unit which generates a time based, predetermined function in response to said sensed web tension affecting interference, said time based function being dependent on the material from which said web is formed and defining at least one of an amount and duration of a reduction in a reference value of said web tension in response to said occurrence of said web tension affecting interference; and employing said time based function selectively reduce the reference value of said web tension.

45. The method of claim 44 further including storing at least one value of an amount of change of said reference value in said computing unit.

46. The method of claim 45 further including reducing said reference value discontinuously in time intervals.

47. The method of claim 44 further including using said computing unit for storing at least one correlation for determining a change of said reference value.

48. The method of claim 44 further including maintaining said reference value as a desired tension value for a constant time interval.

49. The method of claim 44 further including reducing said reference value in one step.

50. The method of claim 44 further including providing a regulating device and using said regulating device for maintaining said web tension at said reference value.

51. The method of claim 44 further including changing said reference value during one of run-up of said interference or during said interference.

52. The method of claim 44 further including performing a roll change for causing said interference.

53. The method of claim 44 further including connecting an old web and a new web and using said connecting for changing said reference value.

54. The method of claim 44 further including providing a first printing unit in said processing machine and altering said reference value of said web tension before, in a transport direction of said web, said first printing unit.

55. The method of claim 54 further including providing a web draw-in unit and using said web draw-in unit for changing said reference value.

56. The method of claim 54 further including connecting a new web and an old web and changing said reference value during said connection.

57. The method of claim 54 further including providing a web connection and changing said reference value at least during a passage of said connection before, in said transport direction a last clamping point located before said first printing unit.

58. The method of claim 44 further including changing said reference value and maintaining said changed reference value for a time interval.

59. The method of claim 58 further including returning said reference value to said existing value after said time interval.

60. The method of claim 59 further including using a time function for returning said reference value.

61. The method of claim 60 further including returning said reference value discontinuously in time intervals.

62. The method of claim 58 further including returning said reference value to a new constant reference value different from said existing value after said time interval.

63. The method of claim 62 further including using a time function for returning said reference value.

64. The method of claim 63 further including returning said reference value discontinuously in time intervals.

65. A device for regulation of tension in a web of material passing through a processing machine comprising:

a regulating device adapted to maintain tension in a web at a reference value;

means for sensing an actual existing value of a tension in a web;

means for sensing the occurrence of a web tension varying interference in the web;

a computing unit adapted to store information regarding the material which forms the web as well as at least one value of web processing affecting the web;

means for storing in said computing unit at least one correlation for determining a change in said reference value in response to the sensing of said tension varying interference, said correlation being dependent on the material which forms said web; and means for reducing said actual existing value of said tension to below said reference value to counteract said interference by use of said computing unit to control said regulating device through application of said correlation.

66. The device of claim 65 wherein said reference value is reduced by a predetermined value with respect to said actually existing value.

* * * * *

UNITED STATES PATENT AND TRADEMARK OFFICE

CERTIFICATE OF CORRECTION

PATENT NO. : 7,191,973 B2
APPLICATION NO. : 10/501922
DATED : March 20, 2007
INVENTOR(S) : Harald Karl Gretsch and Reinhard Georg Gross It is certified that error appears in the above-identified patent and that said Letters Patent is hereby corrected as shown below:

Col. 9 Claim 1, Line 44, after "a" change "serected" to
--selected--; and

Col. 11 Line 49, after "function" insert
--to--.

Signed and Sealed this

Twenty-fourth Day of July, 2007

JON W. DUDAS
*Director of the United States Patent and Trademark Office*